US008555589B2

(12) United States Patent
Semmens et al.

(10) Patent No.: US 8,555,589 B2
(45) **Date of Patent: *Oct. 15, 2013**

(54) ROOFING SYSTEM

(75) Inventors: Blaine K. Semmens, Tacoma, WA (US); Colin R. Murphy, Seattle, WA (US)

(73) Assignee: MOS, LLC, Seattle, WA (US)

( * ) Notice: Subject to any disclaimer, the term of this patent is extended or adjusted under 35 U.S.C. 154(b) by 1501 days.

This patent is subject to a terminal disclaimer.

(21) Appl. No.: 11/332,403

(22) Filed: Jan. 13, 2006

(65) Prior Publication Data

US 2007/0130864 A1 Jun. 14, 2007

Related U.S. Application Data

(63) Continuation-in-part of application No. 11/288,905, filed on Nov. 29, 2005, now abandoned.

(51) Int. Cl.
*E04B 7/00* (2006.01)

(52) U.S. Cl.
USPC ..... 52/409; 52/410; 52/746.11

(58) Field of Classification Search
USPC ..... 52/408, 409, 410, 746.11
See application file for complete search history.

(56) References Cited

U.S. PATENT DOCUMENTS 1,644,965 A * 10/1927 Welch ..... 106/669
2,008,718 A * 7/1935 Jenkins ..... 428/138
2,407,470 A * 9/1946 Blott et al. ..... 106/283
2,421,721 A * 6/1947 Smith et al. ..... 52/612
2,450,258 A * 9/1948 Skolnik ..... 106/649
2,692,219 A * 10/1954 Slayter et al. ..... 428/102
2,854,344 A * 9/1958 Comisso ..... 106/731
3,125,479 A * 3/1964 Finan ..... 156/300
3,230,995 A * 1/1966 Shannon ..... 156/166
3,266,206 A * 8/1966 Cosby et al. ..... 52/309.9
3,282,008 A * 11/1966 Sheahan ..... 52/516
3,302,362 A * 2/1967 Lang ..... 52/742.13
3,345,241 A * 10/1967 Shannon ..... 428/114
3,411,256 A * 11/1968 Best ..... 52/408
3,466,222 A * 9/1969 Curtis ..... 428/142
3,598,688 A * 8/1971 Bellamy ..... 428/67
3,763,614 A * 10/1973 Hyde et al. ..... 52/309.9
3,778,304 A * 12/1973 Thompson ..... 427/243
3,817,767 A * 6/1974 Bozer ..... 106/719
3,937,640 A * 2/1976 Tajima et al. ..... 156/71
3,951,885 A * 4/1976 Thompson ..... 521/137
3,957,571 A * 5/1976 Bodycomb, Jr. ..... 162/3
3,991,252 A * 11/1976 Kolakowski et al. ..... 52/309.9
4,122,203 A * 10/1978 Stahl ..... 428/318.4
4,141,744 A * 2/1979 Prior et al. ..... 106/617
RE31,007 E * 8/1982 Best ..... 52/408
4,374,687 A * 2/1983 Yamamoto ..... 156/71

(Continued)

*Primary Examiner* — Robert Canfield
*Assistant Examiner* — Brent W Herring
(74) *Attorney, Agent, or Firm* — Blue Filament Law PLLC; Avery N. Goldstein

(57) ABSTRACT

A roofing system includes an insulation layer and an exposed fiber surface of a sheet. A cement layer is placed intermediate therebetween. An elastomeric outer weatherproof coating overlies the sheet. A process for applying to a roofing system is provided that includes applying to a roofing substrate an insulation layer having an upper surface. Wet cement is applied on the upper surface of the insulation layer. An exposed fiber surface of a sheet is placed in contact cement. The sheet is then either directly or with intermediate layers therebetween overlayered with an elastomeric weatherproof coating. An insulation board is also provided that includes an exposed fiber backing. The exposed fiber backing accepts an overlayer of elastomer, cement, or mastic.

13 Claims, 4 Drawing Sheets

(56) References Cited

U.S. PATENT DOCUMENTS

| | | | | |
|---|---|---|---|---|
| 4,544,410 | A * | 10/1985 | Karacsonyi nee Eva Spindler et al. | 106/278 |
| 4,587,164 | A * | 5/1986 | Freeman | 428/314.4 |
| 4,699,822 | A * | 10/1987 | Shu | 428/198 |
| 4,783,942 | A * | 11/1988 | Nunley et al. | 52/309.1 |
| 4,818,595 | A * | 4/1989 | Ellis | 442/68 |
| 5,039,454 | A * | 8/1991 | Policastro et al. | 252/610 |
| 5,251,415 | A * | 10/1993 | Van Auken et al. | 52/407.4 |
| 5,270,108 | A * | 12/1993 | Savoy | 428/305.5 |
| 5,406,764 | A * | 4/1995 | Van Auken et al. | 52/408 |
| 6,108,993 | A * | 8/2000 | Hageman | 52/408 |
| 6,286,280 | B1 * | 9/2001 | Fahmy et al. | 52/408 |
| 6,531,200 | B2 * | 3/2003 | Zickell et al. | 428/40.1 |
| 6,769,215 | B1 * | 8/2004 | Carkner | 52/411 |
| 6,783,799 | B1 * | 8/2004 | Goodson | 427/140 |
| 6,833,188 | B2 * | 12/2004 | Semmens | 428/361 |
| 7,101,628 | B2 * | 9/2006 | Peng | 428/516 |
| 7,155,866 | B2 * | 1/2007 | Bezubic et al. | 52/287.1 |
| 7,178,306 | B2 * | 2/2007 | Fritz | 52/746.11 |
| 2002/0129745 | A1 * | 9/2002 | Semmens | 106/802 |
| 2004/0185288 | A1 * | 9/2004 | Peng | 428/515 |
| 2005/0042437 | A1 * | 2/2005 | Ramesh et al. | 428/304.4 |
| 2005/0058832 | A1 * | 3/2005 | Semmens | 428/361 |
| 2006/0105147 | A1 * | 5/2006 | Stroppiana | 428/172 |
| 2006/0144005 | A1 * | 7/2006 | Tonyan et al. | 52/653.1 |
| 2006/0191223 | A1 * | 8/2006 | Bontrager | 52/411 |
| 2007/0017418 | A1 * | 1/2007 | Dennis | 106/685 |

* cited by examiner

ROOFING SYSTEM

RELATED APPLICATIONS

This application is a continuation-in-part application of U.S. patent application Ser. No. 11/288,905 filed Nov. 29, 2005, the contents of which are incorporated by reference.

FIELD OF THE INVENTION

The present invention in general relates to low profile roofing systems, and in particular to an exposed fiber layer roofing membrane.

BACKGROUND OF THE INVENTION

Safety concerns and regulations are making the inclusion of fire-resistant boards within a roofing system more commonplace. Currently, structural insulated panels or other prefabricated sheets are used for this purpose. These panels are typically produced from cellulose reinforced cement board as outside skins and applied as a sheathing to a wall or roof section. The fire-resistant properties of such a board are enhanced by application of a layer of calcium sulfate, magnesium oxy-chloride, or asbestos onto the board or forming such a board from magnesium oxy-chloride, while attachment of panels for wall sections is an efficient process owing to the large number of passageways associated with a wall surface. However, in a roofing setting such fire-resistant boards create considerable difficulties associated with transporting heavy and brittle cementitious panels to the point of application. The subsequent operation to cut such panels within industry acceptable tolerances represents a time-consuming and skilled task. Considerable efficiencies in applying fire-resistant low slope roofs could be achieved through the elimination of fire-resistant boards in roofing systems.

Recognition of the societal value of reflectance and emittance standards for roof weatherproofing membrane barriers has created a desire to produce a roofing system with varied properties which is amenable to use in a re-roofing application. While various intermediate layers between a roof substrate and an external membrane have been tried to achieve these standards, these have met with limited success.

Thus, there exists a need for a new roofing intermediate layer that is capable of securing a membrane layer to an overlying membrane. With the use of magnesium oxide based fire-resistant intermediate layer formable in place on a roof surface, the resulting magnesium oxide layer acts as an adhesive towards a variety of component surfaces found in a commercial roofing system including an overlying membrane. Alternatively, an exposed fibrous surface of an intermediate layer asphaltically joined to an underlayer receives an elastomeric overcoat to form a weatherproof roofing system.

SUMMARY OF THE INVENTION

A roofing system includes an insulation layer and an exposed fiber surface of a sheet. A cement layer is placed intermediate therebetween. An elastomeric outer weatherproof coating overlies the sheet. Various layers optionally are provided intermediate between the sheet, such a second cement layer supporting another exposed fiber surface that terminates on the opposing surface with an asphaltic precoating. The asphaltic precoating is readily fused to another asphaltic layer to define a barrier. If the other asphaltic layer has an exposed fiber surface in opposition to the side fused to the asphaltic precoating, an elastomeric weatherproof coating is applied directly thereto.

A process for applying to a roofing system is provided that includes applying to a roofing substrate an insulation layer having an upper surface. A wet cement is applied on the upper surface of the insulation layer. An exposed fiber surface of a sheet is placed in contact cement so that the cement penetrates at least in part the exposed fiber surface. The sheet is then either directly or with intermediate layers therebetween overlayered with an elastomeric weatherproof coating.

An insulation board is also provided that includes an exposed fiber backing. The exposed fiber backing is adherent to the insulation and accepts an overlayer of elastomeric weatherproof coating or a cement adhesive to bond subsequent layers. The interfacial strength created by joining insulation and a fibrous backing serves to enhance the wind stability of the resultant roofing system.

DESCRIPTION OF THE PREFERRED EMBODIMENTS

Figure 1:
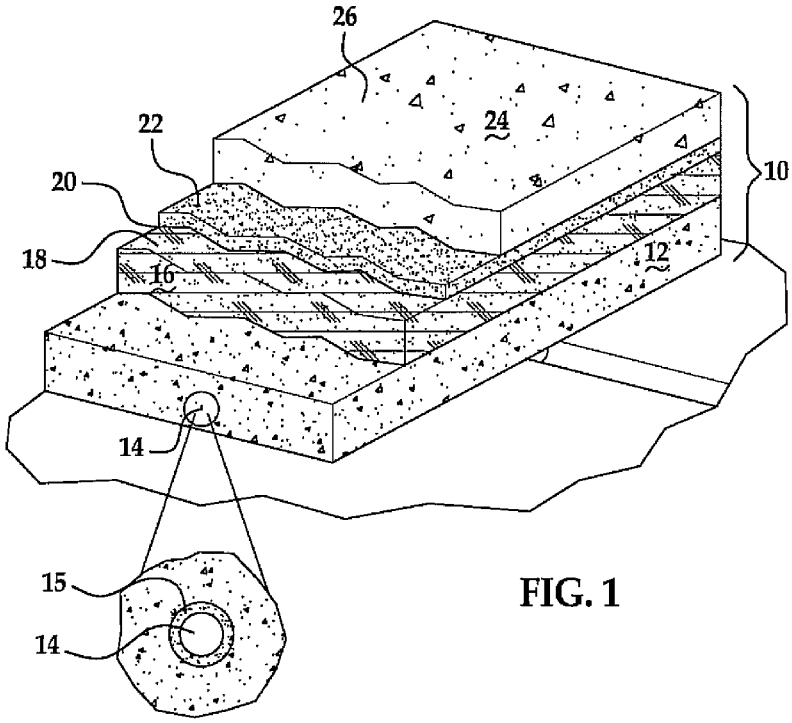
FIG. 1 is a partial cutaway perspective view of a roof system containing an inventive magnesium oxide adhesive.

The present invention has utility in the formation of an intermediate layer binding a roofing substrate to an overlying weatherproofing membrane. In a preferred embodiment, fire-resistant adhesive is provided for securing a roof system to a cementitious substrate. Alternatively, an intermediate roll material is applied with an asphaltic bottom layer contacting a roof substrate and having an exposed fibrous layer well suited to bond to a bottom surface of an overlying outer membrane. The present invention finds uses in roofing materials, structural coatings, and construction panel fabrication. Through the admixing of particulate or fiber having a dispersing coating thereon to suppress electrostatic attraction and make the particulate or fiber hydrophilic, a magnesium oxide cement matrix is rendered sufficiently viscous to preclude flow out through voids or openings within a substrate deck level. Such particulate or fiber also has the added benefit of reducing the overall density of the resulting adhesive.

As used herein, a magnesium oxide cement is defined to include magnesium oxy-chloride, magnesium oxy-sulfate and magnesium phosphate where the terms "cement" and "matrix" are used herein synonymously independent of whether particulate or fibers are dispersed therein.

A magnesium oxide cement according to the present invention is loaded with synthetic polymer particulate or fibers. A synthetic polymer particulate or fiber operative herein is a hydrophobic expanded material illustratively including polystyrene, polyisocyanurate, polypropylene, polyethylene, other polyalkylenes and polyurethanes. Preferably, the synthetic polymer is polystyrene. As a result of synthetic polymer particulate grinding and sieving, electrostatic attractions develop therebetween.

A dispersant coating operative herein to suppress electrostatic attraction between synthetic polymer particulate particles includes a wide variety of materials. It is appreciated that such a coating also optionally affords benefits associated with increasing insolubility, plasticity and adjustment of the surface tension of the slurry. A dispersant coating substance operative herein illustratively includes slack lime; magnesium oxide; nonionic asphalt roof emulsion; cationic or anionic asphalt emulsions, such as a road emulsion; ionic styrene butadiene rubber emulsions; neoprene containing emulsions; and combinations thereof. It is preferred that an asphalt emulsion is modified with a like pH modifier, such as a rubber for use herein. Additionally, particulate dispersing coatings are also operative to suppress electrostatic attraction between synthetic polymer particulate. Powder type dispersing coatings operative herein illustratively include water-insoluble carbonates, carboxylic acid salts, oxides and mixed oxides of metals from periodic table groups II, III and/or IV, and specifically include calcium carbonate, magnesium carbonate, barium carbonate, zinc carbonate, magnesium stearate, calcium palmitate, zinc stearate, aluminum stearate, zinc oxide, aluminum oxide, titanium dioxide, silicon dioxide, magnesium silicate, calcium silicate, aluminum silicate, and combinations thereof; insoluble hydroxides such as magnesium hydroxide, calcium hydroxide; magnesium phosphate, fumed silica, type F fly ash; type C fly ash; aluminum sulfate and other insoluble sulfates; and combinations thereof. Preferably, powder dispersing agent only lacks water to create a reactive dispersal. Organic polymeric dispersants operative herein illustratively include a copolymer of polyvinyl chloride with other authentically unsaturated monomers such as vinyl acetate or vinyl alcohol, acrylic resins, polyimides, epoxy resins and ionic detergents. Preferably, the dispersant coating is present from 0.125 to 0.75 pounds per gallon of synthetic polymer particulate. More preferably, the dispersant coating material is present from 0.125 to 0.50 pounds per gallon of synthetic polymer particulate.

A magnesium oxide matrix material surrounds the dispersed particulate. The matrix material is present from 0.5 to 5 pounds per gallon of dispersed particulate. Preferably, the material is magnesium oxy-sulfate. More preferably, the cementitious matrix material is present from 2 to 4 pounds of activated matrix material per gallon of dispersed particulate.

In a preferred process, dispersant coated particulate or fibers are supplied in measured bag quantities, the bagged particulate or fibers being mixed with magnesium oxide cement at the roof application jobsite. The particle or fiber containing magnesium oxide cement upon mixing is amenable to delivery to a roof substrate through pumping or conveying systems conventional to the art. The particulate or fiber material having the dispersant coated pre-applied thereto is readily wet by the magnesium oxide cement. An open-cell foam or high surface area fragmented particulate or fibers are capable of absorbing the surrounding cement matrix slurry and holding the slurry in a mass until matrix set. While the amount of particle or fiber containing magnesium oxide cement slurry applied to a roof surface is largely within the purview of one of skill in the art, typical slurry thicknesses range from one-quarter to one inch. As the slurry is spread, it forms a seamless cementitious densifying layer that seals cracks and voids associated with a substrate. Additionally, it is appreciated that such a layer has considerable adhesive tack at the exposed interface not only to cementitious substrates, but also a variety of laminate layers associated with a conventional low slope roofing system. An additional benefit of an inventive adhesive slurry is affording a fire-resistant layer without resort to the transport and handling of preformed fire-resistant boards.

An inventive intermediate layer is optionally compacted with pressure in areas of lap joints to improve the profile and decrease seam voids where one roof sheet roll overlaps a second such sheet. As the inventive adhesive is applied as a slurry, it fills in voids like pits, fractures and fastener pullouts in concrete and insulation surfaces. The inventive adhesive is optionally extruded into excessive cracks in insulation boards.

A modified version of an inventive formulation is operative to fill low areas that tend to pond water. In such a usage, preferably the particulate is of larger size with a mean particle size of greater than one-quarter inch long axis length or vermiculite. Optionally, the inventive slurry is mixed with surfactant to break the surface tension to afford a particle-rich slurry, compared to the above detailed inventive slurry amenable to wetting hydrophobic surfaces. Preferably, the higher density inventive slurry detailed above overlays this filler to ensure consistent coverage throughout the system. Water diversion from behind small curbed protrusions is also practiced in combination with the dual density adhesive provided.

An inventive intermediate layer upper surface is optionally overlayered with a non-woven fiber mat that is embedded at least in part within the matrix. A partially embedded mat serves as an adhesion surface for an asphaltic membrane layer. Preferably, the fiber mat is completely embedded within the inventive adhesive matrix such that wet cementitious slurry is exposed on the upper surface of the fiber mat, the mat affording modified mechanical properties to the adhesive. Typical fiber mats operative herein include woven and non-woven polyester, glass and polyalkylenes such as polypropylene and polyethylene.

An inventive intermediate layer is applied to roofing substrate by any rotosater driven delivery system. This type of machine applies a ribbon or bead of an inventive slurry in a profile that is regulated by parameters such as pump speed and application wand rate of motion. Compressed air injected at the nozzle affords for even application through repetitive passes as inventive slurry is extruded and contacts a roofing substrate. In a preferred embodiment, a more controlled application apparatus is used. With an extension coupled to the applicator nozzle terminus that bifurcates from the delivery hose orifice into a manifold of smaller orifices, a more uniform and wider ribbon of an inventive slurry is applied. With the use of such a manifold applicator, an inventive slurry is readily extruded right along the top edge of a previously installed roofing membrane sheet without contaminating the lap joint of the roofing membrane sheet with a contacting second membrane roofing sheet. Additionally, it is appreciated that angling such a manifold tipped applicator wand allows for uniform delivery of an inventive slurry between spaces less than the width of the manifold. Regardless of the particulars of an inventive slurry application, upon spreading an inventive adhesive, the applied adhesive is preferably groomed to a uniform thickness through resort to a heavy roller after spreading a fiber mat and preferably a roofing membrane thereover. The roofing membrane is preferably an elastomeric water-impervious barrier layer.

It is appreciated that the lower surface of such a barrier membrane must grip an inventive intermediate layer to ensure a good bond at the interface. Membrane surfaces well suited for forming good interfacial adhesion with an inventive adhesive include styrene-butadiene-styrene (SBS) polymer modified granular surface sheets inverted and placed into contact with an inventive adhesive. Additionally, a fleece-backed surface of a polyvinyl chloride membrane affords good interfacial bonding. Preferably, conventional membrane is formed with the omission of an asphaltic layer from one side of the base ply leaving an exposed polyester fiber surface amenable to forming a good interface with an inventive magnesium oxide adhesive. Such an asphaltic layer missing membrane achieves sufficient uplift strength while providing an excellent surface for a new membrane application after roof removal. Knife cut strips of the asphaltic layer lacking membrane release with sufficient application of force to induce pull up.

Referring now to FIG. 1, a partial cutaway of an inventive roof system is depicted generally at 10. A magnesium oxide slurry 12 contains particulate and/or fibers 14 having a pre-applied dispersant coating 15 thereon to suppress electrostatic attraction and is applied to a substrate S. A woven or non-woven synthetic fiber mat 16 is optionally present. The mat 16 if present is at least partially embedded within the matrix and preferably the upper surface 18 of the fiber mat 16 is wetted with matrix material 20 that has been pressed through the mat 16. The top layer of matrix material 20 forms an interfacial bond with a lower surface 22 of an elastomeric roof membrane 24. The interfacial surface 22 of the membrane 24 illustratively includes exposed polyester fiber, an SBS modified granular surface sheet or a fleece-backed polyvinyl chloride membrane. The top surface 26 of membrane 24 is an asphaltic material or modified asphaltic surface such as that obtained by modifying the surface with SBS.

Figure 2:
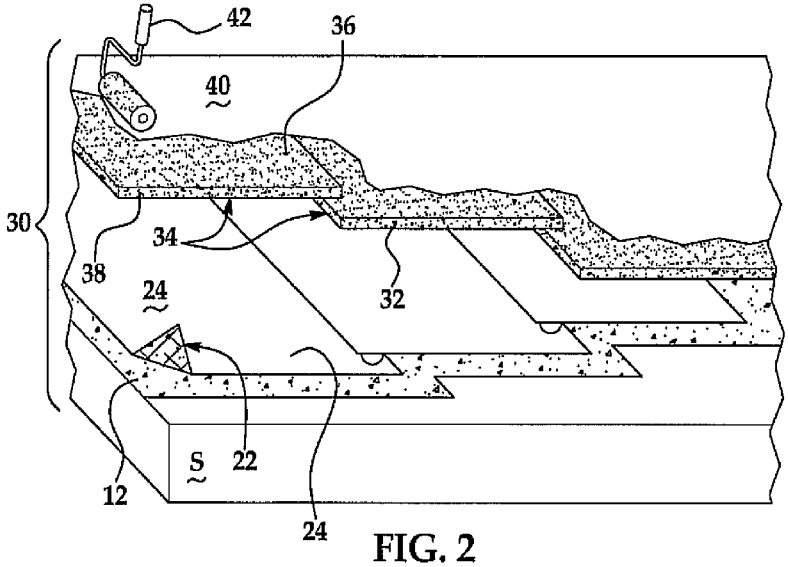
FIG. 2 is a partial cutaway perspective exploded view of an exposed fiber surface intermediate layer overlayered with an elastomeric coating.

Referring now to FIG. 2, an alternative roofing system structure is depicted as a partial cutaway exploded view generally at 30. A rolled roofing material 32 has an asphaltic side 34 contacting a substrate and an exposed non-asphaltic fibrous surface 36. The asphaltic side 34 forms an interfacial bond with the substrate. While the substrate depicted in FIG. 2 is top surface 26 of the roof system depicted in FIG. 1 at 10, it is appreciated that any conventional asphalt containing surface, or surface adhesively bondable to asphalt is operative herein. The fibrous surface 36 includes a woven or non-woven synthetic fiber mat extending from an asphaltic layer 38 that terminates in the asphaltic side 34. The exposed fibrous surface 36 is porous and amenable to receive an elastomeric roof coating 40, such as conventional polyacrylic containing products. Preferably, the coating 40 is applied with a sponge roller as depicted at 42. An elastomeric roof coating 40 having a white or silver color is appreciated to provide superior reflectance and emittance values compared to heat absorptive dark colored coatings.

Figure 3:
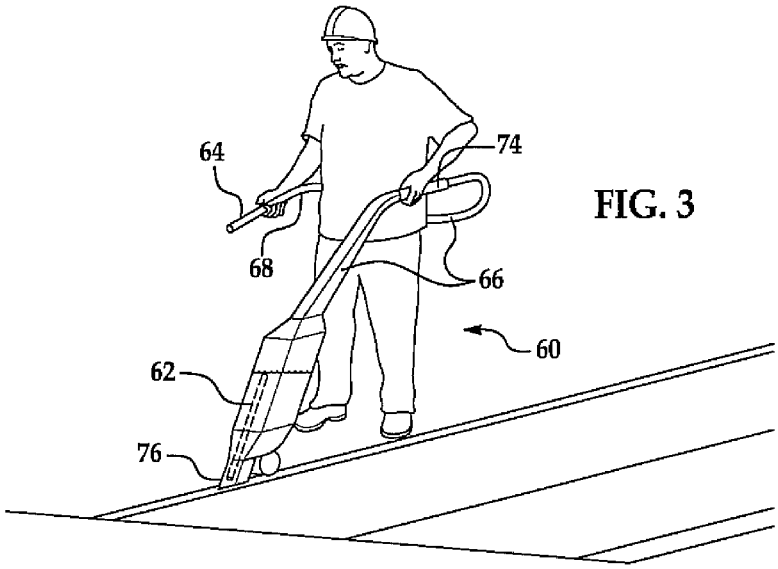
FIG. 3 is a perspective view of an applicator apparatus.

While a thermoset head lap or seam lap is readily applied to a membrane system in a factory process, field applied asphalt or interply adhesive is appreciated to also be operative herein. The preferred method of sealing absent factory thermoset lap formation is the injection of SBS modified asphalt at the proper transition temperature to ensure the fusion of the asphaltic side of a membrane to an exposed polyester side of a previously removed membrane layer lacking a lower asphaltic coating. SBS modified asphalt is so applied with a small rooftop kettle that fills a gravity-fed apparatus with a trigger-operated flow mechanism. Preferably, an applicator tip is designed to slide freely between the laps or the extrusion of material therebetween. Application of SBS modified asphalt to all seams followed by contact with for instance a four inch heavy roller causes fusion of the membrane while compressing the still soft but setting adhesive slurry thereby leveling the profile of the lap. A novel apparatus for application is depicted in FIG. 3 generally at 60. The apparatus 60 has a heating element 62 that melts pieces, synonymously referred to as charges, of SBS modified asphalt 64 that are inserted into an opening 66 that allows the charge to be forced past the heating element 62 under gravity feed or a pressure source. Preferably, the pieces of SBS modified asphalt 64 are size and shape matched to insert within the opening 66 and as depicted are preferably cylindrical in shape. The heating element 62 is preferably electrically powered via line power 68. The constant introduction of cold material charges 64 quickly equalizes the temperature of a reservoir 70. As such, a thermostat can be set to the rate of flow required to inject material into the laps. The reservoir 70 terminates in a tip 72 adapted to insert under a lap and fluid communication to the tip 72 under the control of a handle 74 connected to a valve 76 intermediate between the reservoir 70 and the tip 72. The applicator 60 is mounted on a wheel 78 that serves to compress just applied asphalt.

Regardless of the method used to seal lap joints between membranes overlying an inventive adhesive, the present invention achieves the following beneficial results. The membrane roll material can be applied bidirectionally so as to in theory double the rate of application by allowing an installer to turn around at an end and apply the material in the opposite direction instead of returning to the starting point as conventional factory installed laps require. Additionally, the end laps of such a membrane overlying an inventive adhesive are reversed for all rainwater flow directions for any situation such as crickets and other slope changes.

Figure 4:
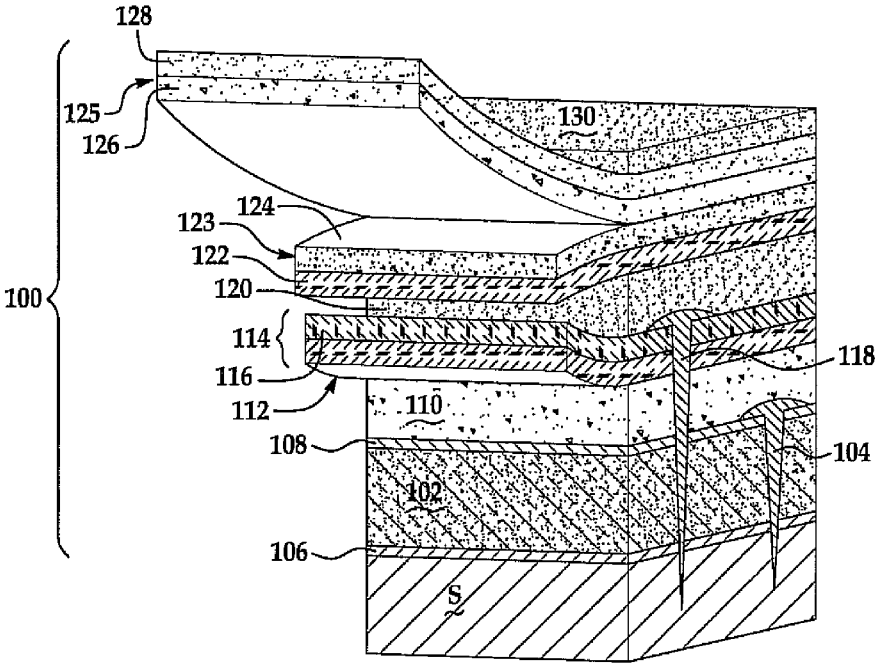
FIG. 4 is a perspective, partially delaminated inventive roofing system embodiment depicted with optional mechanical fasteners in cross section and in which relative thickness of layers has been distorted for illustrative purposes.
Figure 5:
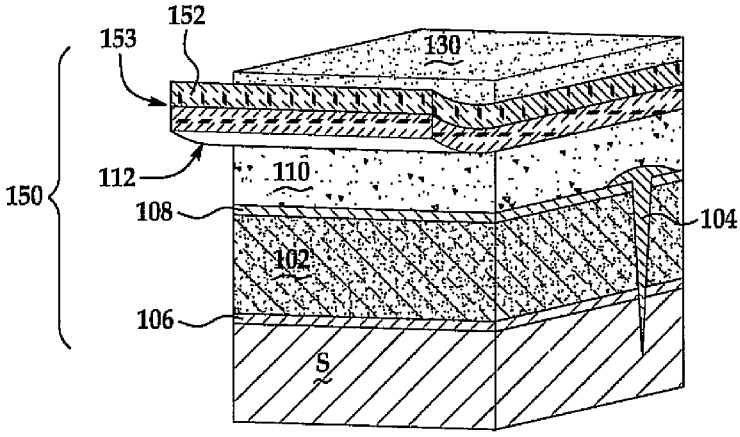
FIG. 5 is a perspective, partially delaminated inventive roofing system depicting another embodiment depicted with optional mechanical fasteners in cross section and in which relative thickness of layers has been distorted for illustrative purposes.
Figure 6:
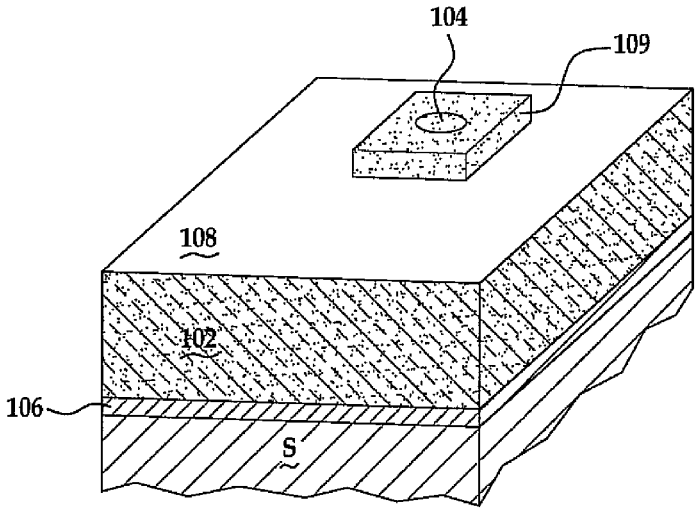
FIG. 6 is a perspective view of an inventive system for securing insulation to a roof substrate.

Referring now to FIGS. 4 and 5, inventive roof system is depicted generally at 100 and 150, respectively, with common elements being identified with like numerals. An insulation material 102 is placed on a roofing substrate S. The roofing substrate S is any conventional roofing structure such as steel decking, plywood, or oriented strand board (OSB). The insulation material 102 is secured to the substrate S by a conventional technique appropriate for the substrate S. By way of example, contact adhesive or mechanical fasteners are well suited for securement of insulation board material 102. Insulation material 102 is a low density material having a thickness chosen to impart a preselected R-value, based on the insulation board composition. Typical R-values for roofing insulation range from 2 to 10. Compositions from which roof insulation are foams illustratively include polystyrene, polyurethane, and polyisocyanurate. While in a preferred embodiment, the insulation material 102 is a deployed as a prefabricated board, it is appreciated that a foam applied onto a substrate S is also operative herein with the proviso that the foam be sufficiently planar to facilitate buildup of the subsequent layers of the roofing system 100. It is appreciated that a spray-applied foam is amenable to mechanical planarization after application. More preferably, insulation material 102 in the form of boards is secured to a substrate S with a mechanical fastener 104, alone or in combination with an adhesive 106 so to enhance the wind stability of an inventive roofing system 100. Insulation material 102 provided as manufactured boards is provided with an optional backing 108 on one or both faces. The backing 108 in conventional insulation board is a paper or metalized layer. Most preferably, the insulation material 102 has an exposed fiber backing, as detailed with respect to FIG. 7.

A magnesium oxide cement 110 is applied to a paper layer 106, if present, or an exposed surface of the insulation material 102 so as to form a layer having a thickness of from 0.1 to 1 inch in thickness. It is appreciated that the cement 110 optionally includes particulate or fiber fillers. Spaced ribbons, expanded polystyrene spheres, and chopped fibers are representative to such inclusions. An exposed fiber surface 112 of sheet 114 is laid into the wet magnesium oxide cement 110 with the net result that cement 110 fills the interstitial spaces between fibers. The fiber sheet 114 or 153 is either woven or non-woven and is formed from a variety of fibers illustratively including fiberglass; polyester; and polyalkylene, specifically including polypropylene geofiber. Preferably, the insulation 102 with the optional paper layer 108—cement 110 and partially embedded fiber surface 112 of sheets 114 or 153 is fabricated in a factory setting and arranged to tile a roof substrate S.

In regard to FIG. 4, the opposing surface 116 of the sheet 114 is exposed. Alternatively, the fiber sheet 112 is provided as a rolled material that is unrolled onto the cement 110. After the cement 110 has set embedding the surface 112, the sheet 114 is optionally secured to the substrate S with a mechanical fastener 118.

Regardless of the process by which sheet 114 is applied, an additional layer of magnesium oxide cement 120 is applied to exposed surface 116. An exposed fiber surface 122 of a sheet 123 is embedded in the cement 120 to allow penetration into the surface 122. Preferably, the sheet 123 is delivered to a roof situs as a roll. The opposing surface 124 of sheet 123 is precoated with a substance that leaves the surface 122 exposed. The precoating substance is an asphaltic material. A second sheet 125 is overlayered onto surface 124 with an asphaltic surface 126 of the sheet 125 in contact with the surface 124. The opposing surface is an exposed fiber surface colored coatings.

In regard to FIG. 5, the precoating substance is an elastomeric coating on surface 152 of sheet 153. The application of an additional coat of elastomer 130 in the form of a hardening liquid, directly onto surface 152 completes the roof system. The elastomeric roof coating 130 includes conventional polyacrylic containing products. Preferably, the coating 130 is applied with a sponge roller. An elastomeric roof coating 130 having a white or silver color is appreciated to provide superior reflectance and emittance values compared to heat absorptive dark colored coatings.

In a preferred embodiment, an insulation material 102 and an optional paper backing 108 is secured to roofing substrate S as described with respect to FIGS. 4 and 5 by securing a cement soaked fiber layer 109 intermediate between a fastener 104 and the insulation material 102. The peel strength of the resulting inventive roofing system is thereby enhanced and allowing the roofing system to survive higher prolonged wind gusts. The cement soaked fiber layer 109 is applied either as a continuous sheet underlying multiple fasteners 104 or as discontinuous sections, each of which is secured by a single fastener 104. The cement soaked fiber layer 109 typically has a thickness of between 1/16 and 1 inch. Preferably the thickness is between 1/16 and 3/8 of an inch. The cement soaked fiber layer 109 serves to limit the deformation the laminate of comparatively soft insulation experiences under high winds upon securement to an underlying substrate. The fiber layer is preferably applied as cement pre-wet, discontinuous sections. More preferably, the discontinuous section has a surface area of at least three times the fastener head surface area. Optionally, the fiber layer pre-wet with cement is allowed to set up prior to driving the fastener therethrough into the underlying insulation and substrate. Additionally it is appreciated that placing a pool of cement beneath a fastnere prior to dringin the fastener entrains some cement in the fastener hole to further improve adhesion. After securement of the laminate of cement soaked fiber layer—insulation to the substrate, additional layers are applied as detailed above with respect to FIGS. 4 and 5 beginning with addition of a cement layer 110.

Figure 7:
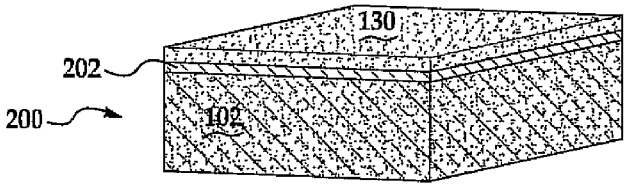
FIG. 7 is a perspective view of an inventive exposed fiber insulation board.

An insulation board having an exposed fiber backing is depicted in FIG. 7 generally at 200, where like reference numerals correspond to those described above with respect to FIGS. 4 and 5. The insulation board 200 has an insulation layer 102 having an exposed fiber backing 202. The insulation layer 102 typical has a thickness of between 1 and 6 inches and preferably between 1.5 and 4 inches. The open structure of a fiber layer allows the insulation foam to penetrate the fiber loops on one side during extrusion and allow cement to penetrate the opposing side of the fiber backing. If the foam is open celled, preferably this cement slurry is provided at a viscosity such that it will seep into the open cells of the foam, further enhancing interfacial bond strength. The insulation layer preferably penetrates partially into the fiber backing 202 so as to leave exposed fibers on the upper surface 204. The exposed fiber backing is typically bare of insulation to a thickness of between 1/32 and 2 inches. Partial insulation penetration into the fiber backing affords resistance against delamination between insulation layer 102 and the backing 202 while allowing an overcoating of cement adhesive or elastomeric coating to wick into the exposed fiber backing 202. An inventive board 200 is readily formed by pouring a viscous insulation polymer syrup resin over a fiber material with control over syrup resin viscosity or residence time prior to foaming to assure exposed fibers remain on the surface 204. It is appreciated that the foaming conditions are dictated by the properties of the insulation polymer resin and are known to the art. Alternatively, a pressure adhesive is placed intermediate between a bare insulation surface and a fiber mat to form an inventive board.

Figure 8:
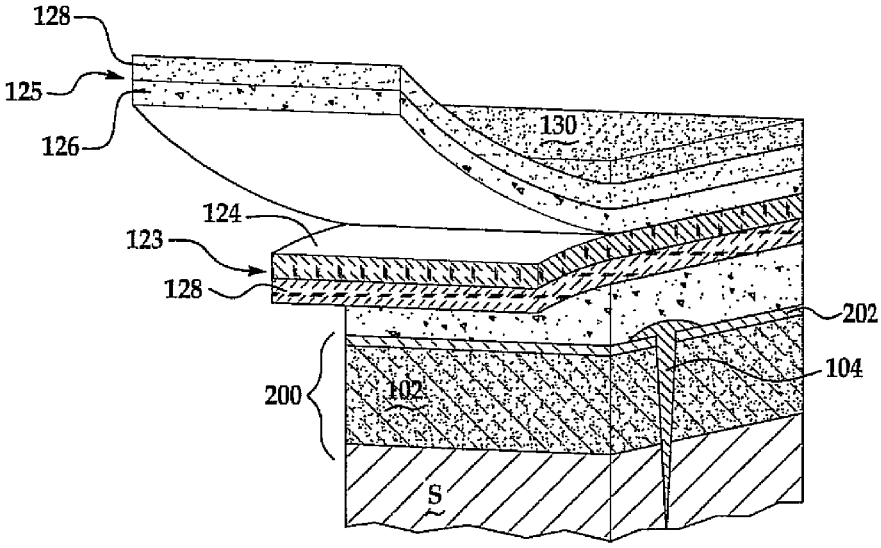
FIG. 8 is a perspective, partially delaminated inventive roofing system further embodiment employing an exposed fiber insulation board of FIG. 7, depicting with optional mechanical fasteners in cross section and in which relative thickness of layers has been distorted for illustrative purposes.
Figure 9:
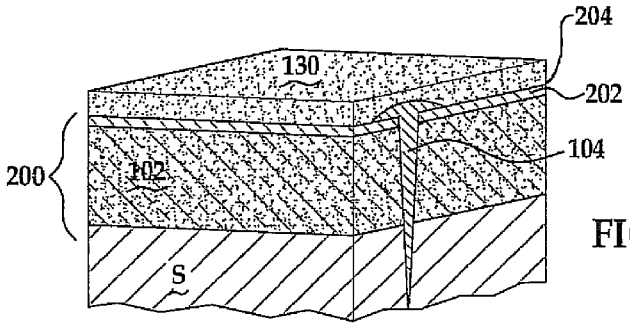
FIG. 9 is a perspective inventive roofing system employing an exposed fiber insulation board of FIG. 7 with an elastomer roof coating applied with optional mechanical fasteners in cross section and in which relative thickness of layers has been distorted for illustrative purposes.

The usage of an insulation board having an exposed fiber backing 202 in a roofing system is depicted in FIGS. 8 and 9 where like numerals correspond to those detailed above with respect to FIGS. 4 and 5. The insulation board has an exposed fiber backing 202 as shown in FIG. 8 and has a cement layer 110 to bond securely to the exposed fiber backing 202 and join the backing 202 to an exposed fiber surface 122 of a sheet 123 having an opposing asphaltic surface 124. A mechanical fastener 104 or a pressure adhesive intermediate between the insulation layer 102 and a substrate S, or a combination thereof is used to anchor the board 200. Through resort to the insulation board having an exposed fiber backing 200, the layers 114 and 120 of the roofing system depicted in FIG. 4 are effectively eliminated. A second sheet 125 is overlayered onto surface 124 with an asphaltic surface 126 of the sheet 125 in contact with the surface 124. The opposing surface is an exposed fiber surface 128, comparable to surface 122. The proximal surfaces 124 and 126 of sheets 123 and 125, respectively are fused together with a conventional heat source, such as a hot asphaltic applicator or a flame source. The exposed fiber surface 128 is then sealed with a coat of elastomer 130 in the form of a hardening liquid, directly onto surface 128 completes the roof system and additional fabric layers optionally interlaced with coating on the seams. The elastomeric roof coating 130 includes conventional polyacrylic containing products. An elastomeric roof coating 130 having a white or silver color is appreciated to provide superior reflectance and emittance values compared to heat absorptive dark colored coatings.

In FIG. 9, the board 200 is anchored to a substrate S with a mechanical fastener 104, or a pressure adhesive intermediate between the insulation layer 102 and a substrate S, or a combination thereof. The exposed fiber surface 204 is then sealed with a coat of elastomer 130 in the form of a hardening liquid, directly onto surface 204 seals the system. It is appreciated that a board 200 in a vertical orientation also serves as a wall substrate with a plaster, cement, or mastic being applied to the exposed fiber surface 204.

The foregoing description is illustrative of particular embodiments of the invention, but is not meant to be a limitation upon the practice thereof. The following claims, including all equivalents thereof, are intended to define the scope of the invention.

The invention claimed is:

1. A roofing system comprising:

an insulation layer;

a woven or non-woven synthetic fiber mat having an exposed fiber surface, said mat having an opposing surface to the exposed fiber surface;

a magnesium oxide cement layer in simultaneous contact with said insulation layer and the exposed fiber surface of said mat, said mat partially embedded in said cement layer with the exposed fiber surface embedded into said cement layer; and an elastomeric outer weatherproof coating overlying the opposing surface of said mat; and an elastomeric precoating on the opposing surface to the exposed fiber surface of said mat, said elastomeric precoating in contact with said elastomeric outer weatherproof coating.

2. The system of claim 1 further comprising an asphaltic precoating on the opposing surface of said mat, said asphaltic precoating fused to a second asphaltic precoating on a second mat, said second mat having a second exposed fiber surface amenable to receive said elastomeric outer weatherproof coating.

3. The system of claim 1 wherein said cement further comprises dispersant coated particles or fibers therein.

4. The system of claim 3 wherein said dispersant coated particles or fibers are hydrophobic expanded material coated with a dispersant coating substance.

5. The system of claim 3 wherein said cement is present from 0.5 to 5 pounds per gallon of said dispersant coated particles or fibers.

6. The system of claim 1 wherein said insulation layer is a board.

7. The system of claim 1 further comprising a fastener securing a cement soaked fiber layer and said insulation layer to a substrate.

8. The system of claim 1 wherein said cement is magnesium oxy-chloride, magnesium oxy-sulfate or magnesium phosphate.

9. A roofing system comprising:

an insulation layer;

a first woven or non-woven synthetic fiber mat having a first exposed fiber surface, said first mat having a first opposing surface to the first exposed fiber surface;

a magnesium oxide cement layer in simultaneous contact with said insulation layer and the first exposed fiber surface of said first mat, said first mat partially embedded in said cement layer with the first exposed fiber surface embedded into said cement layer;

an elastomeric outer weatherproof coating overlying the first opposing surface of said first mat;

a second cement layer intermediate between the opposing surface of said mat, and a second woven or non-woven synthetic mat having a second exposed fiber surface, said second woven or non-woven synthetic mat having a second asphaltic precoating in opposition to the second exposed fiber surface, the second asphaltic precoating fused to a third asphaltic precoating on a third woven or non-woven synthetic mat, said third mat having a third exposed fiber surface amenable to receive an elastomeric outer weatherproof coating; and an elastomeric precoating on the opposing surface to the exposed fiber surface of said mat, said elastomeric precoating in contact with said elastomeric outer weatherproof coating.

10. The system of claim 9 wherein said cement further comprises dispersant coated particles or fibers therein.

11. The system of claim 10 wherein said dispersant coated particles or fibers are hydrophobic expanded material coated with a dispersant coating substance.

12. The system of claim 9 further comprising a fastener securing a cement soaked fiber layer and said insulation layer to a substrate.

13. The system of claim 9 wherein said cement is magnesium oxy-chloride, magnesium oxy-sulfate or magnesium phosphate.

* * * * *